US006536505B1

(12) United States Patent
Pleschiutschnigg

(10) Patent No.: US 6,536,505 B1
(45) Date of Patent: Mar. 25, 2003

(54) METHOD AND APPARATUS FOR PRODUCING THIN SLABS IN A CONTINUOUS CASTING PLANT

(75) Inventor: Fritz-Peter Pleschiutschnigg, Duisburg (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/507,288

(22) Filed: Feb. 18, 2000

Related U.S. Application Data

(62) Division of application No. 09/004,431, filed on Jan. 8, 1998, now Pat. No. 6,129,137.

(51) Int. Cl.[7] ..... B22D 11/12
(52) U.S. Cl. ..... 164/417; 164/424; 164/441
(58) Field of Search ..... 164/476, 483, 164/484, 417, 424, 441

(56) References Cited

U.S. PATENT DOCUMENTS 5,511,606 A * 4/1996 Streubel ..... 164/476
5,803,155 A * 9/1998 Lavazza et al. ..... 164/476
5,836,375 A * 11/1998 Thone et al. ..... 164/436
5,839,503 A * 11/1998 Pleschiutschnigg ..... 164/436
5,964,275 A * 10/1999 Flick et al. ..... 164/476

* cited by examiner

*Primary Examiner*—Tom Dunn
*Assistant Examiner*—I.-H. Lin
(74) *Attorney, Agent, or Firm*—Friedrich Kueffner

(57) ABSTRACT

A method and an apparatus for producing slabs in a continuous casting plant preferably equipped with a vertical mold, preferably for thin slab plants for casting preferably steel having, for example, a solidification thickness of 60 mm–120 mm, for example, 80 mm, and casting speeds of up to 10 m/min. and a maximum casting output of about 3 million tons per year. In a first vertically extending first segment 0 of a strand guide, exclusive strand reduction, also called casting and rolling, is carried out. The segment 1 arranged immediately underneath the first segment 0 carries out bending of the strand through several bending points into the inner circular arc. Prior to final solidification, the strand is bent back through several return bending points into the horizontal.

8 Claims, 4 Drawing Sheets

METHOD AND APPARATUS FOR PRODUCING THIN SLABS IN A CONTINUOUS CASTING PLANT

CROSS-REFERENCES TO RELATES APPLICATION

This application is a divisional of 09/004,431, filed on Jan. 8, 1998 and now issued as U.S. Pat. No. 6,189,137.

BACKGROUND OF THE INVENTION

1. Field of the Invention

The present invention relates to a method and an apparatus for producing slabs in a continuous casting plant preferably equipped with a vertical mold, preferably for thin slab plants for casting preferably steel having, for example, a solidification thickness of 60 mm–120 mm, for example, 80 mm, and casting speeds of up to 10 m/min. and a maximum casting output of about 3 million tons per year.

2. Description of the Related Art

The thin slab plants known in the art for producing a slab thickness reduction, realized in a casting and rolling device, reduce the strand thickness immediately underneath the continuous casting mold, which is equipped with one or two pairs of foot rollers, predominantly in the so-called "segment 0". In that segment, the thickness of the strand is reduced, for example, from 65 mm to 40 mm over a metallurgical length of about 2 m, i.e., over the entire length of the segment or stand 0, which is not arranged vertically, wherein the casting speed is at most 6 m/min. A plant having these characteristics results in a strand thickness reduction of at most 38% and a deformation speed in the strand thickness of at most 1.25 mm/s.

During this holding time of the strand with liquid core, the strand shell having a thickness of about 8–12 mm is substantially deformed when entering the segment 0 due to bulging of the strand shell between the rollers of the continuous casting plant. This internal deformation increases with increasing casting speed and height of the plant or also the ferrostatic pressure, and decreases with decreasing spacing between the rollers. It is to be noted in this connection that the roller diameter cannot be less than, for example, 120 to 140 mm because of mechanical construction criteria, i.e., mechanical load, structural limits particularly in the case of intermediately arranged rollers. A possible mechanical solution could be a sliding plate, also called "grid", which, however, is not suitable for carrying out a reduction of the strand thickness.

In normal continuous casting, the internal deformation is essentially determined by

- bulging of the strand between rollers;
- bending of the strand from the vertical into the inner circular arc;
- straightening of the strand into the horizontal;
- deviation of the rollers from the ideal strand guiding line due to
  - roller jumps;
  - roller impacts; and
  - tensile stress.

Added to these internal deformations and also the surface deformations must be the deformations which are produced by the strand thickness reduction or also the casting and rolling process in the segment 0. This specific internal deformation is superimposed on the deformation already produced in the segment 0 caused essentially by the strand bulging and the bending process from the vertical into the internal circular arc. This cumulation of the individual specific deformations may lead to a total deformation which becomes critical and leads to rupture not only of the inner strand shell but also the outer strand shell.

This type of additional load acting on the strand shell due to casting and rolling or the thickness reduction during the solidification in the segment 0 having a length of, for example, 2 m immediately underneath the mold is described in German patents 44 03 048 and 44 03 049 and is illustrated in detail as an example in the diagram of FIG. 1 of the drawing.

As shown in FIG. 1, a vertical mold having a length of 1 m and provided with one or two pairs of foot rollers is followed by a segment 0 having a length of 2 m in which the strand is bent over several stages into the inner circular arc and is also reduced in its thickness. These two processes or deformations taking place simultaneously lead to a superimposed cumulated total deformation composed of the bending deformation D-B and the casting and rolling deformation D-Gw. The total deformation D-Ge which acts on the strand shell may become greater than the critical limit deformation D-Kr and may lead to ruptures of the inner strand shell as well as of the outer strand shell. This danger increases with increasing casting speed due to a roller spacing or roller diameter in segment 0 which may not become smaller than a certain limit because of mechanical reasons.

In addition, when describing this problem, it must be taken into consideration that the limit deformation D-Kr has a specific behavior in each steel quality. For example, a deep drawing quality is less critical with respect to the absorption of deformations without the consequences of ruptures than, for example, a microalloyed steel quality API X 80.

Moreover, the configuration and extension of the overheated melt or also of the pure molten steel phase in the strand, indicated by the straight line G1 in dependence on the casting speed, has a significant influence of the internal quality of the strand. In the example illustrated in FIG. 1, the pure molten steel phase or also the geometrically lowest liquidus temperature in the middle of the strand extends up to about 1.5 m below the meniscus or casting level at a casting speed VG of 5 m/min and to about 3.0 m underneath the casting level at a casting speed VG of 10 m/min. Underneath this point, the two phase area composed of melt and crystal is present over the entire strand thickness, wherein the two phase area looses melt portion in favor of crystal portion proportionally with increasing distance in the direction toward the sump tip or the final solidification.

When the crystal portion is 50%, i.e., at half the distance between the lowest liquidus point of 1.5 m at, for example, VG5 m/min and the final solidification which takes place at about 15 m, i.e., at 8.25 m (1.5 m+ (15 m–1.5 m)×0.5=8.25 m) (percent by weight), the melt/crystal phase has a viscosity of 10,000 cP. When the crystal portion is 80%, the two phase area has a viscosity of 40,000 cP, while the pure molten steel phase, depending on the steel quality, has to the lowest liquidus point a viscosity of only about 1–5 cP and, moreover, its partial viscosity between the crystals (crystal network or dendrites) is practically not increased, i.e., is constant, up to the final solidification.

To provide a reference of the viscosities in the two phase area mentioned above to known substances of everyday life, the following substances shall be mentioned:

| | | |
|---|---|---|
| Water | at 20° C. | 1 cp = 10 exp3 Ns/m exp2 |
| Olive oil | at 20° C. | 80 cp = |
| Honey | at 20° C. | 10 000 cp |
| Nivea | at 20° C. | 40 000 cp |
| Margarine | at 20° C. | 100 000 cp |
| Bitumen | at 20° C. | 1 000 000 cp |

These viscosities illustrate that for a good forced convection and, thus, a good destruction of crystals by a strand thickness reduction, a crystal/melt structure should be present in the core of the strand, i.e., at maximum casting speed the strand should have in its core already a two phase area in the region of the segment 0 or the pure molten steel phase or also the overheated area or the penetration zone for the rising of oxides should no longer be present. These conditions in connection with the oxidic degree of purity have led to the finding that, on the one hand, the segment 0 should be vertical and, on the other hand, the segment 0 should only serve for the strand thickness reduction and not also additionally for bending the strand.

In FIG. 1, which illustrates the poor conditions described above, the overheated zone or the lowest liquidus points extends to the end of the segment 0 and, thus, already into the inner circular arc of the continuous casting plant in the case of a maximum casting speed of 10 m/min, as indicated by point 1.1 on straight line G1. These casting conditions are extremely unfavorable for the strand shell deformation as well as for the oxidic degree of purity.

The two phase area, extending between two straight lines, i.e., the straight line G1 for the arrangement of the lowest liquidus point in dependence on the casting speed and the straight line G2 for the lowest solidus point or the final solidification in dependence on the casting speed, begins in the case of the maximum casting speed of 10 m/min at the end of segment 0 which carries out the strand thickness reduction.

In FIG. 3 of the drawing, partial illustration 3*a*, i.e., the left half of FIG. 3, also shows as an example the pattern of the different phases of a strand having a thickness of 100 mm from the meniscus in the mold with a subsequent strand thickness reduction in the segment 0 having a length of 2 m from 100 mm to 80 mm solidification thickness to the final solidification in the last segment number 14 for the maximum casting speed of 10 m/min. Partial illustration 3*a* once again makes it very clear that segment 0 imparts into the strand the highest possible deformation caused by the strand thickness reduction and the bending process from the vertical into the inner circular arc through five bending points as well as poor conditions for oxides rising into the meniscus, and, thus, into the casting slag.

Partial illustration 3*a* also illustrates that the reduction speed which acts on the shell of the strand for reducing the thickness from 100 mm to 80 mm, i.e., by 20%, is 0.833 mm/s at a casting speed of 5 m/min and is 1.66 mm/s at a casting speed of 10 m/min. This reduction speed of the strand thickness represents a direct measure of the deformation of the strand shell which at the entry into the segment 0 has a thickness of about 10.3 mm at a casting speed of 5 m/min and about 7.3 mm at a casting speed of 10 m/min. This strand deformation caused by casting and rolling is high and is not only doubled from 0.83 to 1.66 mm/s by the speed increase from 5 to 10/min, as expressed by the simplified variable 1.66 mm/s, but the speed increase enters the deformation with a quadratic function.

These high deformations, additionally superimposed by the bending processes in segment 0, lead to the danger of cracks of the inner strand shell as well as of the outer strand shell, particularly in the case of steel qualities which are sensitive to cracks.

SUMMARY OF THE INVENTION

Therefore, in view of the findings and relationships described above, it is the primary object of the present invention, based on devices for the strand thickness reduction immediately below the mold, to propose a method and a plant concept for a high-speed continuous casting plant for slabs which ensure an optimum surface quality and internal quality of the steel strand.

In accordance with the present invention, in a first vertically extending first segment 0 of the strand guiding means, exclusive strand reduction, also called casting and rolling, is carried out. The segment 1 arranged immediately underneath the first segment 0 carries out bending of the strand through several bending points into the inner circular arc. Prior to final solidification, the strand is bent back through several return bending points into the horizontal.

The continuous casting plant according to the present invention for carrying out the above-described methods includes a vertically extending segment 0 for a strand thickness reduction of between 40 and 10 mm. The following segment 1 has at least three bending points and the radius of the inner circular arc of this segment is between and 6 and 3 m. For bending the strand back from the inner circular arc into the horizontal, at least three straightening points are provided and the last return bending point at 80% of the maximum casting speed has a distance from the sump tip of at least 2 m.

The present invention provides an unexpected solution for the various complex problems described above, as described below in more detail. Particularly, the present invention ensures and combines the following features:

- a minimum ferrostatic pressure or also a minimum plant height between the meniscus in an oscillating vertical mold, advantageously driven hydraulically, and the final solidification in the horizontally extending portion of the strand guiding means;
- minimized deformation density distribution of the total deformation composed of casting and rolling deformation and the bending deformation in a vertical bending unit with concavely constructed wide sides of the mold, predetermined roll diameters in the strand guiding means and up to maximum casting speeds of, advantageously 10 m/min;
- a complete elimination of the overheating phase or penetration zone for rising oxides in the vertical portion of the continuous casting plant, i.e., in segment 0 which is the machine element for carrying out the strand thickness reduction at a maximum casting speed of, for example, 10 m/min, for ensuring a strand symmetry in the range of overheating or pure molten steel phase;
- a casting and rolling process at maximum casting speed of, for example, 10 m/min in segment 0 in which the two phase area melt/crystal is present in the middle of the strand at the latest at the end of the segment 0 which carries out strand thickness reduction or casting and rolling;
- a deformation speed of the strand shell in segment 0 of at most 1.2 mm/s;
- a minimized bending deformation density in segment 1 from the vertical through several bending points into the inner circular arc independently of the casting and rolling deformation in the segment 0 which is arranged directly in front of segment 1; and
- a minimized straightening deformation density from the inner plant radius through several straightening or return bending points into the horizontal, preferably at least 12 s or at least 2 m in front of the final solidification in relation to an average casting speed of 80% of the maximum casting speed.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
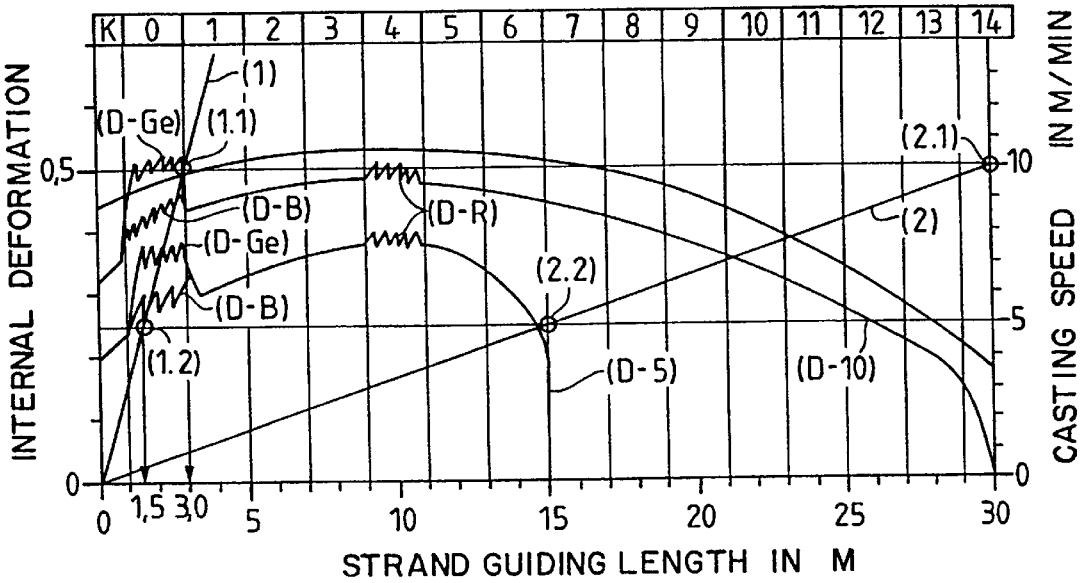
FIG. 1 PRIOR ART
FIG. 1 is a diagram showing the strand conditions in a continuous casting method carried out in accordance with the prior art.
Figure 3A:
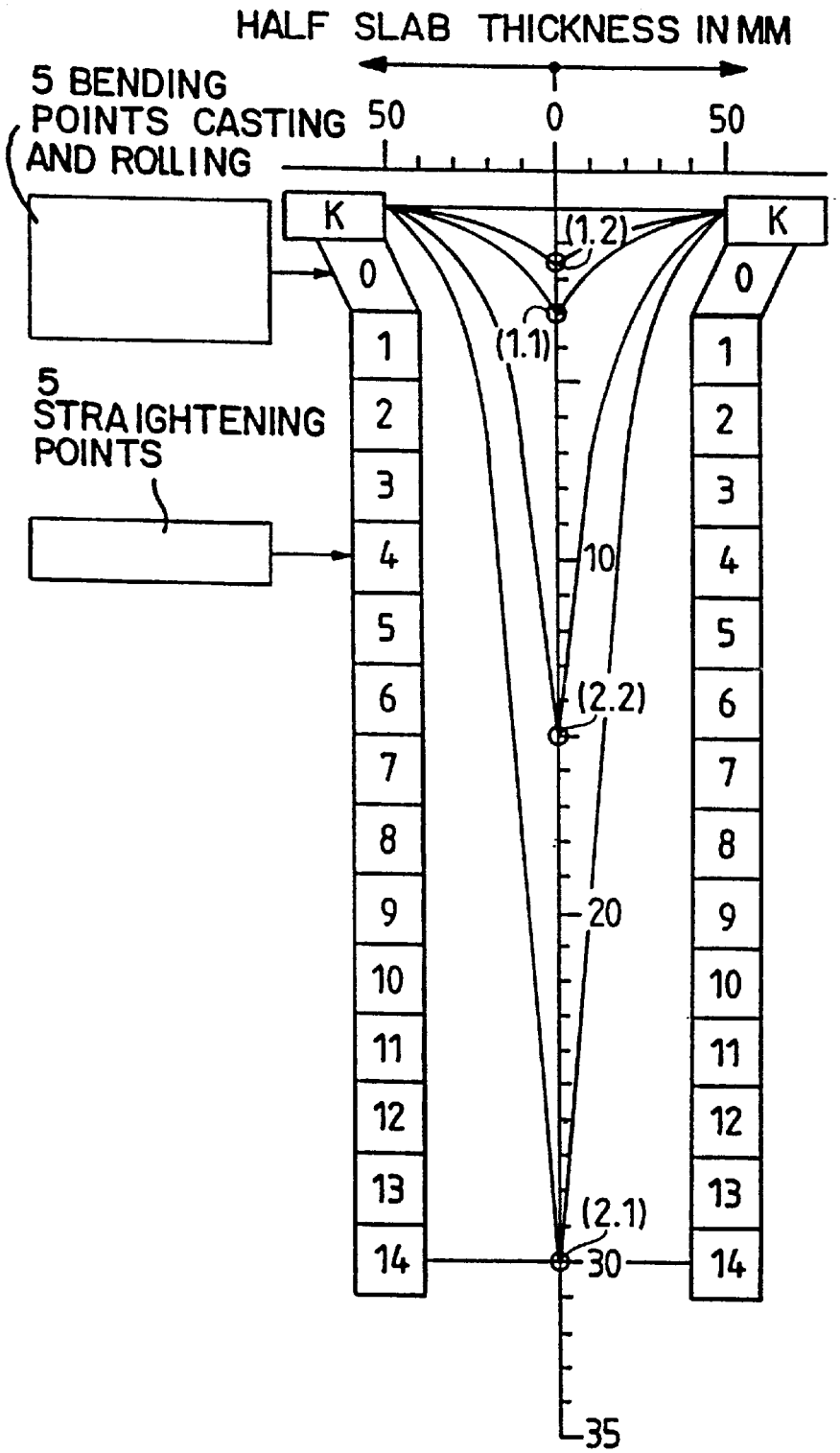
FIG. 3a PRIOR ART
FIG. 3 is a diagram showing in the partial illustration 3*a* a method according to the prior art and in partial illustration 3*b* the method according to the present invention.
Figure 3B:
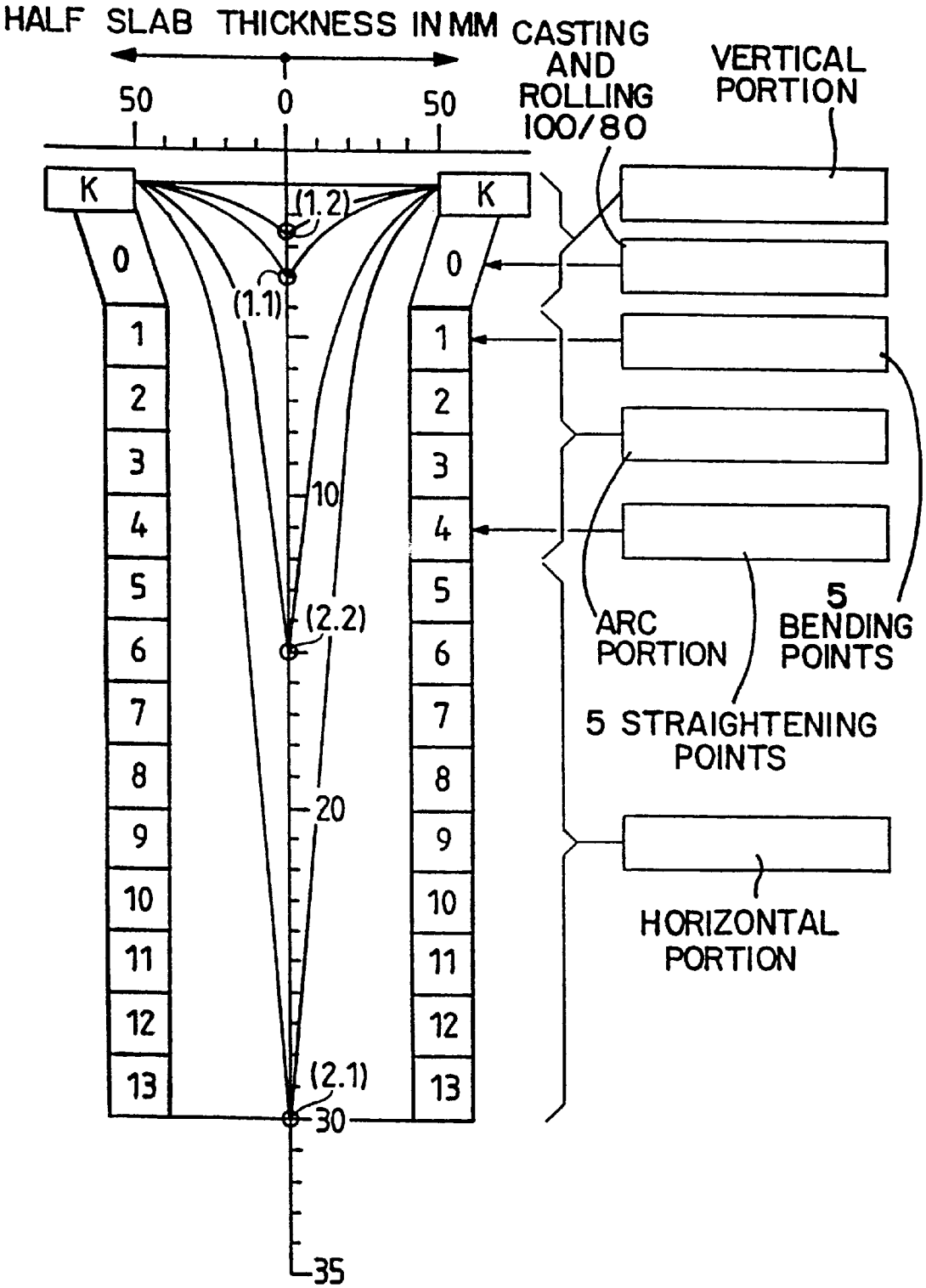
FIG. 3b PRIOR ART

FIGS. 1 and the partial illustration 3*a* of FIG. 3 have already been described above.

Figure 2:
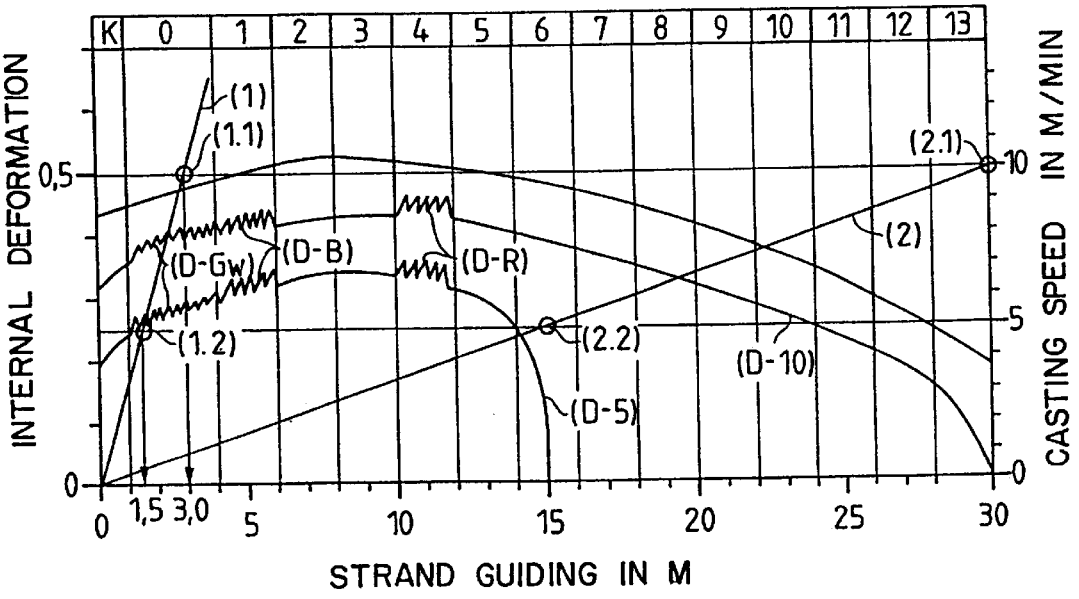
FIG. 2 is a diagram showing the strand conditions in a continuous casting method carried out in accordance with the present invention.

FIGS. 2 and partial illustrations 3*b* of FIG. 3 illustrate the method and the apparatus according to the present invention.

FIG. 2 of the drawing shows the distribution of the internal strand deformation according to the present invention over the strand guiding length with an indication of the plant configuration for the casting speeds 5 and 10 m/min. and the extension of the pure molten steel phase, the final solidification in dependence on the casting speed and the limit deformation.

In accordance with the present invention, the continuous casting method is set up in such a way that the strand deformation density is minimized over the strand guidance and each type of deformation takes places successively independently of the other type of deformation. The deformation curves D-5 and D-10 extend underneath the critical and, thus, limit deformation D-Kr. Moreover, the deformation curves show that a cumulation of the deformation caused by casting and rolling and by bending is avoided because, in the illustrated embodiment, the strand thickness reduction D-Gw is carried out in a vertical segment 0 having a length of 3 m and bending D-B of the strand is carried out in the subsequent segment 1 through, for example, 5 bending points.

FIG. 2 further shows that the lowest liquidus point 1.1 or the overheating zone or the penetration zone in the interior of the strand which constitutes about 10% of the solidification time with overheating of the steel of 25° C. in the distributor extends at the maximum casting speed of 10 m/min up to 3 m underneath the meniscus or 2 m deep into the segment 0. This ensures that the oxides can rise freely and symmetrically until strand solidification in the vertically arranged pure molten steel phase and that, simultaneously, underneath the lowest liquidus point from which the two phase area of the strand interior completely fills out the strand metal, the destruction of the crystals and the suppression of the macro segregation and middle segregation due to the casting and rolling process can take place over the remaining length of 1 m in the segment 0.

The two phase area is located between the straight line G1 which represents the lowest position of the liquidus point and the straight line G2 which represents the position of the sump tip in dependence on the casting speed. In the case of VG 5 m/min, the two phase area crystal/melt begins at about 1.5 m (liquidus point 1.2) underneath the meniscus or 0.5 m after the strand enters the segment 0 and ends at about 15.1 m (2.2) in FIG. 2 with the sump tip; in the case of a casting speed of 10 m/min, the two phase area begins at about 3 m (1.1) and ends with the sump tip at about 30.2 m (2.1), as seen in FIG. 2.

The strand reduction or the casting and rolling process with the full two phase area between the strand shells extends in the case of VG 5 m/min casting speed over 2.5 m of the remaining length of the segment 0 and in the case of VG 10 m/min. over 1 m of the residual length of the segment 0. In both cases, a forced convection of the two phase area and, thus, an improvement of the interior quality of the strand are ensured.

In accordance with FIG. 3, bending back of the strand from the inner radius of, for example, 4 m through several return bending points, for example, 5 straightening points, into the horizontal, is carried out, for example, in segment 4 having a length of 2 m in order to ensure a smooth return deformation D-R and simultaneously prevent a negative influence of the strand deformation on the final solidification and, thus, the internal quality of the strand.

Moreover, the partial illustration 3*b* of FIG. 3 must be discussed. Particularly as compared to the partial illustration 3*a*, it is apparent that the casting and rolling deformation D-Gw from 100 to 80 mm takes place over a segment 0 having a length of 3 m and, thus, with a deformation speed of only p1.11 mm/s in the case of a casting speed of 10 m/min. and with a deformation speed of 0.55 mm/s in the case of a casting speed of 5 m/min. This deformation speed is significantly reduced as compared to that of 1.66 mm/s in the case of a segment 0 having a length of 2 m and a casting speed of 10 m/min. Consequently, the deformation speed is below the value of 1.25 mm/s which is known to be critical.

The advantages provided by the present invention result from ensuring a continuous casting method for thin slabs from a solidification thickness of preferably between 60 and 120 mm with a casting and rolling stage immediately underneath the vertical mold in a vertically arranged segment 0.

Figure 4:
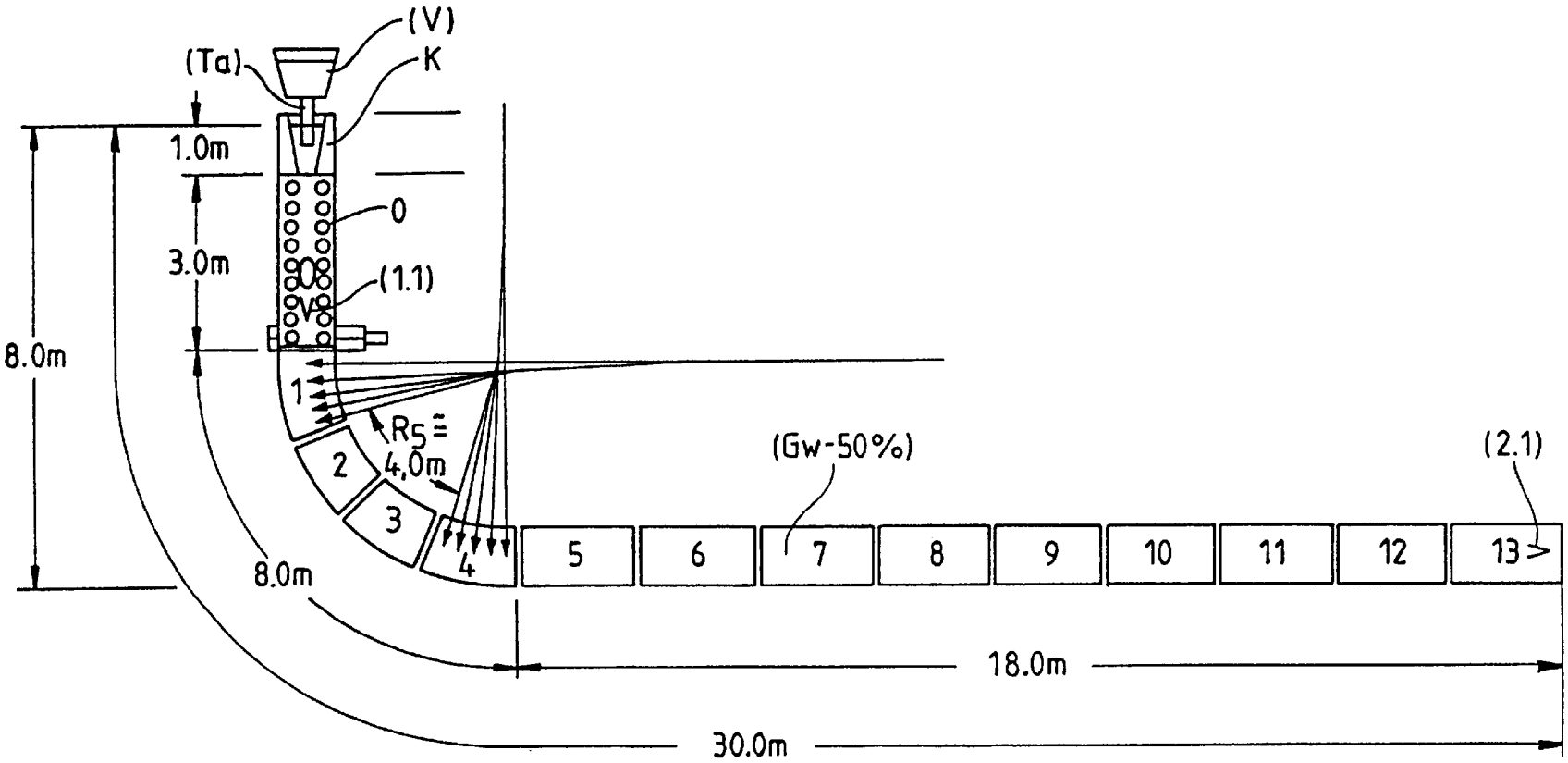
FIG. 4 is a schematic illustration of a continuous casting plant according to the present invention.

The vertical mold, into which steel is conducted from a distributor V by means of a submerged pouring pipe Ta as shown in FIG. 4, should advantageously have concave wide side plates and should be hydraulically driven in order to ensure

- a precise oscillation and the variation of the moving height, of the frequency and the type of oscillation during casting;
- a uniform slag lubrication over the entire strand width;
- a quiet meniscus movement;
- a uniform heat transfer into the mold;
- a concentric strand travel within the mold as well as within the strand guiding means; and
- a high casting safety while avoiding ruptures.

The strand guiding means can also be constructed concavely with a deviation from linearity of at most 2×2 mm in order to provide a straight and secure strand guidance even at high casting speeds. This can be realized, for example, with a concavely constructed profile of the strand guiding rollers. In addition, the degree of the concave deviation does not have to be constant from the mold exit or also from the first strand guiding roller to the last roller of the strand guiding means and can decrease functionally steadily in the direction toward the strand guiding end to a minimum residual concavity or a residual curvature of the strand.

The segment 0 should be arranged vertically and be used exclusively for the strand thickness reduction. The segment 0 should have a minimum length which produces at maximum casting speed a reduction speed of the casting thickness of less than 1.25 mm/s in the strand and simultaneously, also at the maximum possible casting speed, has a minimum length which ensures the complete elimination of overheating and as much as possible also a destruction of the crystal phase in the two phase area crystal/melt and the suppression of the macro segregation and middle segregation. In the illustrated example, the segment 0 has a length of 3 m.

In accordance with the present invention, in segment 1, i.e., immediately following the casting process in segment 0, bending of the strand is carried out with a two phase mixture between the strand shells through, for example, 5 bending points into the inner circular arc of, for example, 4 m, in order to keep the strand shell deformation density small and not to be cumulated with the previously occurring casting and rolling deformation.

In accordance with the geometric relationships and a plant height of, for example, about 8 m, a return bending into the horizontal, for example, through five straightening points in segment 4 occurs at a distance of about 12 m from the meniscus, i.e., a substantial distance in front of final solidification which occurs at a distance of about 15 m from the meniscus in the case of VG 5 m/min. or at a distance of 30 m from the meniscus in the case of VG 10 m/min. Consequently, the time between return bending and the resulting deformation of the inner strand shell and the final solidification which is extremely sensitive to deformations is 36 s or 108 s, so that a harmful influence on the final solidification in the area of the sump tip and the resulting defects in the core of the strand due to the return bending process are excluded.

FIG. 4 of the drawing shows an embodiment of the present invention with a single-line continuous casting plant for producing a maximum of 3.0 million tons per year for an average strand thickness of 100 mm at the outlet of the vertical mold, wherein the vertical mold has a hydraulic drive, the solidification thickness is 80 mm and the maximum casting speed is 10 m/min.; the continuous casting plant includes

- a vertical mold having a length of 1.2 m, a width of at most 180 mm in the middle of the meniscus and a minimum width of 100 mm in the center and a width of 100 mm in the area of the narrow sides at the mold outlet;
- a vertical segment 0 configured as a tong-segment having a length of 3 m for reducing the strand thickness to 80 mm;
- a segment 1 with 5 bending points and an inner radius of 4 m;
- segments 2 and 3 in the inner circular arc;
- a segment 4 with 5 straightening points; and
- segments 5–13 in the horizontal portion of the strand guiding means.

The entire continuous casting plant has a metallurgical length of about 30 m, wherein about 4 m of the length are arranged vertically (KO), about 8 m in the circular arc (segments 1, 2, 3, 4) and about 18 m horizontally (segments 5–13). At the casting speed of at most 10 m/min, the lowest liquidus point 1.1 extends about 2 m into the segment 0 having a length of 3 m, so that it is ensured that oxides rise into the casting slag in an optimum manner and the oxides remaining in the steel are simultaneously symmetrically distributed, while also ensured are a destruction of the crystals in the two phase area and a suppression of the core segregation in the strand. At a distance of about 16.5 m from the meniscus, a two phase mixture of 50% crystal portion (50% by weight) with a viscosity of 10,000 cP (the same as honey at 20° C.) is present. In addition, the final solidification 2.1 takes place in the last segment 13 far away from return bending in segment 4. Between the return bending and the final solidification in the sump tip area, an undisturbed solidification period of about 108 s is available which ensures a good core solidification.

While specific embodiments of the invention have been shown and described in detail to illustrate the inventive principles, it will be understood that the invention may be embodied otherwise without departing from such principles.

I claim:

1. A continuous casting plant for producing thin strands comprising a vertical continuous casting mold, a vertically extending first segment for effecting a strand thickness reduction of between 40 and 10 mm, the first segment being arranged immediately below the mold, a subsequent segment arranged immediately below the first segment comprising at least three bending points, the subsequent segment having a radius of an inner circular arc of between 6 and 3 m, further comprising at least three straightening points for return bending of the strand from the inner circular arc into the horizontal, wherein, at 80% of maximum casting speed, a last return bending point has a distance from a sump tip of at least 2 m, wherein a height between a meniscus level in the mold and a bottom edge of the strand in the horizontally extending strand guiding means is not more than 10 m, wherein the continuous casting plant has a length of at least 10 m.

2. The continuous casting plant according to claim 1, wherein the vertically extending first segment has a length of at least 2 m.

3. The continuous casting plant according to claim 1, wherein the mold has narrow side areas, each narrow side area having a width of between 160 and 70 mm.

4. The continuous casting plant according to claim 1, wherein the vertically extending casting mold has wide side walls, wherein the wide side walls have a horizontally extending concave and symmetrical profile, with an opening in a wide side wall middle of a meniscus area being at most 40 mm on each wide side wall.

5. The continuous casting plant according to claim 4, wherein the concave profile of at most 40 mm on each wide side wall at the meniscus area of the mold is configured to be completely reduced at least at an end of the mold.

6. The continuous casting plant according to claim 4, wherein the concave profile of at most 40 mm on each wide side wall is configured to be reduced from the meniscus of the mold toward the mold end in accordance with a functional pattern to a residual concavity of at most 12 mm on each wide side wall.

7. The continuous casting plant according to claim 6, further comprising a strand guiding means for reducing the residual concavity at a mold outlet in accordance with a functional pattern to a minimum concavity or curvature of the strand.

8. The continuous casting plant according to claim 1, wherein the continuous casting plant is configured for a continuous casting speed of at most 10 m/min.

* * * * *